United States Patent [19]

Aoki et al.

[11] Patent Number: 4,622,801

[45] Date of Patent: Nov. 18, 1986

[54] METHOD AND AN APPARATUS FOR SEALING A NOSE OF A PACKAGING FLAT TUBE BAND AFTER OPENING THE NOSE

[75] Inventors: Seiji Aoki; Gennai Yanagisawa, both of Tokyo, Japan

[73] Assignee: Taiyo Shokai Co., Ltd., Tokyo, Japan

[21] Appl. No.: 604,840

[22] Filed: Apr. 27, 1984

[30] Foreign Application Priority Data

May 2, 1983 [JP] Japan ..... 58-76272

[51] Int. Cl.[4] ..... B65B 63/04

[52] U.S. Cl. ..... 53/429; 53/116

[58] Field of Search ..... 53/116, 117, 255, 260, 53/429, 450, 531, 540, 547, 548, 550, 567; 414/43, 44

[56] References Cited

U.S. PATENT DOCUMENTS

| | | | |
|---|---|---|---|
| 2,767,534 | 10/1956 | Nydegger et al. | 53/540 X |
| 3,124,918 | 3/1964 | Hall et al. | 53/255 X |
| 3,501,889 | 3/1970 | Grulich et al. | 53/585 X |
| 3,662,514 | 5/1972 | Goss | 53/260 X |
| 3,977,152 | 8/1976 | Rochla et al. | 53/429 |
| 4,406,449 | 9/1983 | Buck | 414/43 X |

FOREIGN PATENT DOCUMENTS

| | | | |
|---|---|---|---|
| 2459725 | 7/1976 | Fed. Rep. of Germany | 53/183 |
| 1206702 | 9/1970 | United Kingdom | 53/117 |
| 1334313 | 10/1973 | United Kingdom | 53/429 |

*Primary Examiner*—John Sipos
*Assistant Examiner*—Steven P. Weihrouch
*Attorney, Agent, or Firm*—Martin Smolowitz

[57] ABSTRACT

A method of sealing the nose a packaging flat tube band after opening thereof. The method comprises separately adsorbing the upper and lower films and separating these films away from each other thereby to open the nose, charging a matter to be packaged through the opened nose in the horizontal direction, welding the tube band at both sides of the packaged matter transversely, and cutting the portion of the flat the tube band adjacent to the feed side. These steps are repeatedly to sucessively seal the nose of the packaging flat tube band. Disclosed also is an apparatus suitable for carrying out this nose sealing method.

4 Claims, 13 Drawing Figures

METHOD AND AN APPARATUS FOR SEALING A NOSE OF A PACKAGING FLAT TUBE BAND AFTER OPENING THE NOSE

BACKGROUND OF THE INVENTION

1. Field of the Invention

This invention relates to a method and an apparatus for packaging mainly a trash sack in 20 sheets, 30 sheets or 50 sheets together or sheet-like matters such as synthetic resin film book cover, diaper cover, cloth wrapper and the like other than the trash sack. The invention relates particularly to a method and an apparatus for sealing a nose of a packaging flat tube band after opening the nose and inserting the matter into the tube.

2. Description of the Prior Art

A sheet-like matter of this kind is usually very thin, as using a film of 20 to 10μ or so in thickness. Such sheet-like matters are normally bundled in 20 sheets or 30 sheets, and are inserted in a packaging outer sack manually or mechanically.

However, such sheet-like matter is very thin and soft as mentioned above, therefore its periphery is easy to bend when inserted in the outer sack, and thus not only an external appearance is spoiled thereby but also the thickness of a package at a bent peripheral portion varies from other portions, and hence the difference in thickness is accumulated to lead to unstableness when a multitude of such packages are piled up to storage.

If the sheet-like matter is bent, then the portion must be corrected to straighten carefully by hand, which may involve a troublesome chore.

On the other hand, a mechanical way of insertion will require a tolerance on the outer sack satisfactory enough to cope with the thickness of holding plates which work vertically therefore. Moreover, the holding plates are capable of sticking a bottom of the outer sack to rupture it unless an inserting position of the holding plates is controlled accurately to the outer sack, thus requiring a high standard of skill for operating a control apparatus, and consequently normally a large outer sack with considerable tolerance is employed therefor.

However, the latter case entails an excessively large outer sack, therefore sheet-like matters piled up therein are easy to go out of order after packaging, and further a material of the outer sack is not utilized effectively.

SUMMARY OF THE INVENTION

This invention has been made to improve over defects prevailing on such a known method and apparatus, and its essential object is to provide a method and apparatus, wherein a long flat tube band is utilized as a packaging outer sack, the nose portion is opened accurately large so as to allow even an extremely thin and soft accumulated sheet-like matter group to be inserted into the flat tube band correctly without bending, thus it can be sealed and packed in good appearance, and the sheet-like matter group is not disturbed in the package, thus utilizing the flat tube effectively as a packaging outer sack.

To attain the above-mentioned object, the invention described first refers to a sealing method after opening the nose of a packaging flat tube band, which is characterized in that upper and lower films at the nose of a long synthetic resin packaging flat tube band are adsorbed separately by suction action to part with each other vertically, the nose of the flat tube band is thus opened, a matter group to be packed is inserted horizontally in the flat tube band through the opened nose, the flat tube band is welded transversely at longitudinal positions of the packed matter, a portion ranging to a feed side of the flat tube band is cut transversely, the procedure of which is repeated in sequence.

Then, the invention described second refers to an apparatus for putting the method according to the first invention into practice, and in an apparatus for sealing a long synthetic resin packaging flat tube band after opening its nose to insert a matter to be packed therein, the improvement is characterized in that a mouth sealing means for thermally welding the nose of the packaging flat tube band is disposed at a delivery side of a packaging flat tube band transfer means for transferring the packaging flat tube band in the direction counter to that in which a matter to be packed is inserted, a cutting means, a packaging flat tube band bottom sealing means and a packaging flat tube band mouth opening means are provided in that order between the transfer means and the mouth sealing means from the upstream toward the downstream along the direction in which the packaging flat tube band is transferred, the mouth opening means is provided with a pair of holding jaws each having a decompression sucking disk, so that the upper and lower films of the nose of the packaging flat tube band fed on the transfer means are adsorbed on the sucking disks, and after opening the nose and inserting the matter to be packed therein, the mouth sealing means and the bottom sealing means are actuated to weld the packaging tube band longitudinally of the packed matter, then the cutting means is actuated to cut the packaging tube band near the bottom sealing means at a spot coming near to the transfer means, a sequence control unit thus operating to drive and control the transfer means, the mouth opening means, the bottom and mouth sealing means repeatedly in that order.

BRIEF DESCRIPTION OF THE DRAWINGS

The drawings relate to this invention, wherein.

DETAILED DESCRIPTION OF PREFERRED EMBODIMENTS

Figure 1:
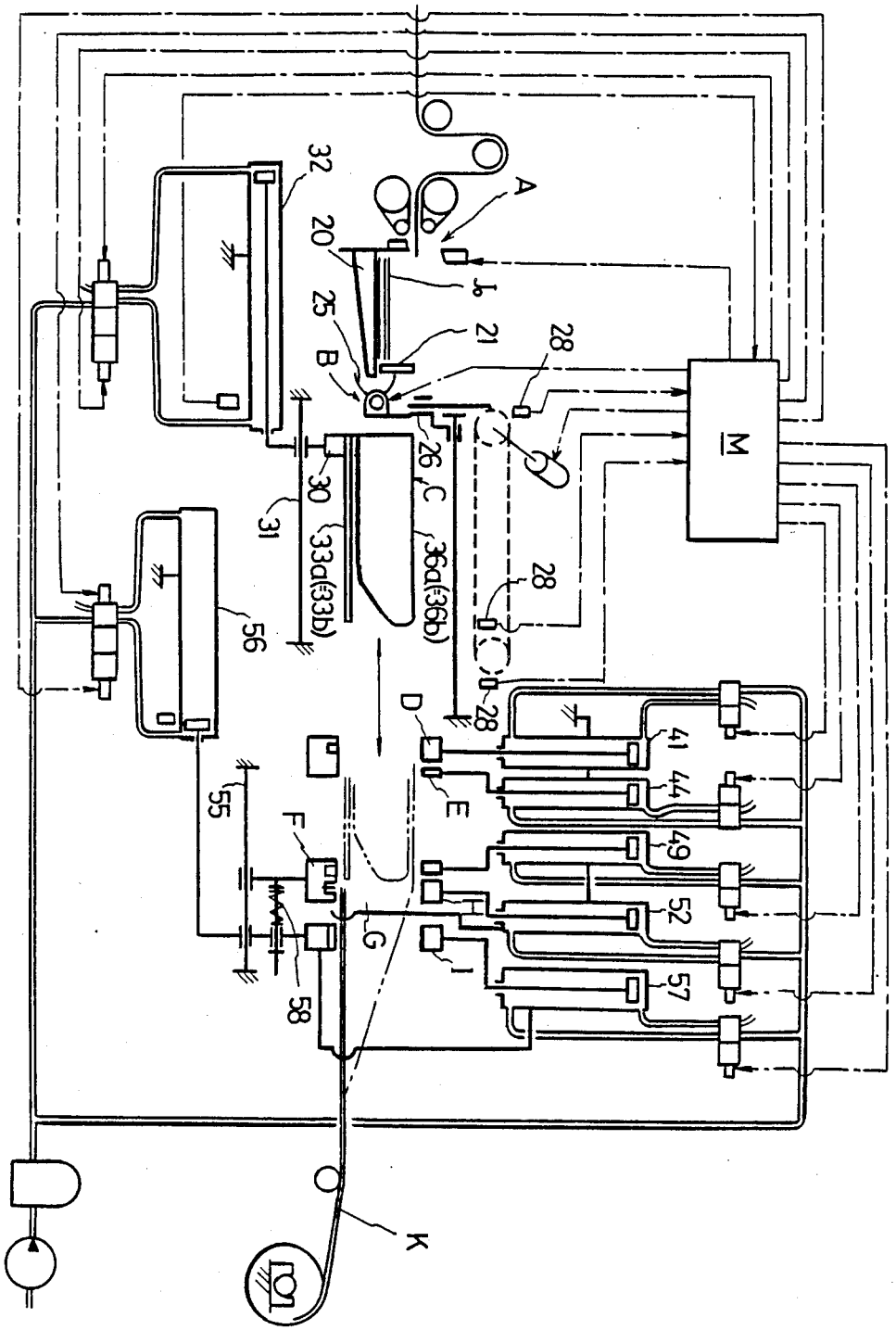
FIG. 1 is a general kinematic scheme of a representative embodiment of an apparatus.

An apparatus given in a representative embodiment of the second or apparatus invention will now be described with reference to the accompanying drawings FIG. 1 to FIG. 11.

In FIG. 1 to FIG. 11, I denotes a packaging flat tube band transfer means, and the packaging flat tube band transfer means I is disposed in a frame so that the direction in which a synthetic resin packaging flat tube band K is transferred by the transfer means I will be opposite to that in which a matter to be packed Jo (see FIG. 6) or piled-up sheet-like matters is bent and inserted in the flat tube band on a piled-up sheet-like matter bending and inserting means C.

A mouth sealing means D for thermally welding the nose of a long packaging flat tube band Ko is disposed on a delivery side of the flat tube band transfer means I, then a cutting means H, a packaging flat tube band bottom sealing means G, a piled-up sheet-like matter retaining means F, a packaging flat tube band mouth opening means E are provided in that order between the transfer means I and the mouth sealing means D from the upstream toward the downstream along the direction in which the packaging flat tube band Ko is transferred, and the mouth opening means E is provided with a pair of upper and lower holding jaws 40*a*, 40*b* having decompression sucking disks 43*a*, 43*b*.

A sack manufacturing machine A for feeding a single sack J by predetermined number of pieces to a piled-up sheet-like matter carrying means B for carrying the piled-up sheet-like matter Jo to the bending and inserting means C, is disposed on a carrying-in side of the carrying means B.

For a product receiver 20 of the sack manufacturing machine A, that of comb-tooth shape at the downstream end is used, which receives the sack J as a sheet-like matter successively onto the product receiver 20 in accumulation, a stopper 21 is kept in contact with the product receiver 20 as long as it is piled up thereon to a predetermined number of pieces, and the stopper 21 ascends on counting the predetermined number of pieces.

A moving pedestal 30 of the inserting means C is mounted slidably on a horizontal guide rail 31 and operated for reciprocation by a pneumatic cylinder unit 32 between the product receiver 20 and the mouth sealing means D.

Figure 3:
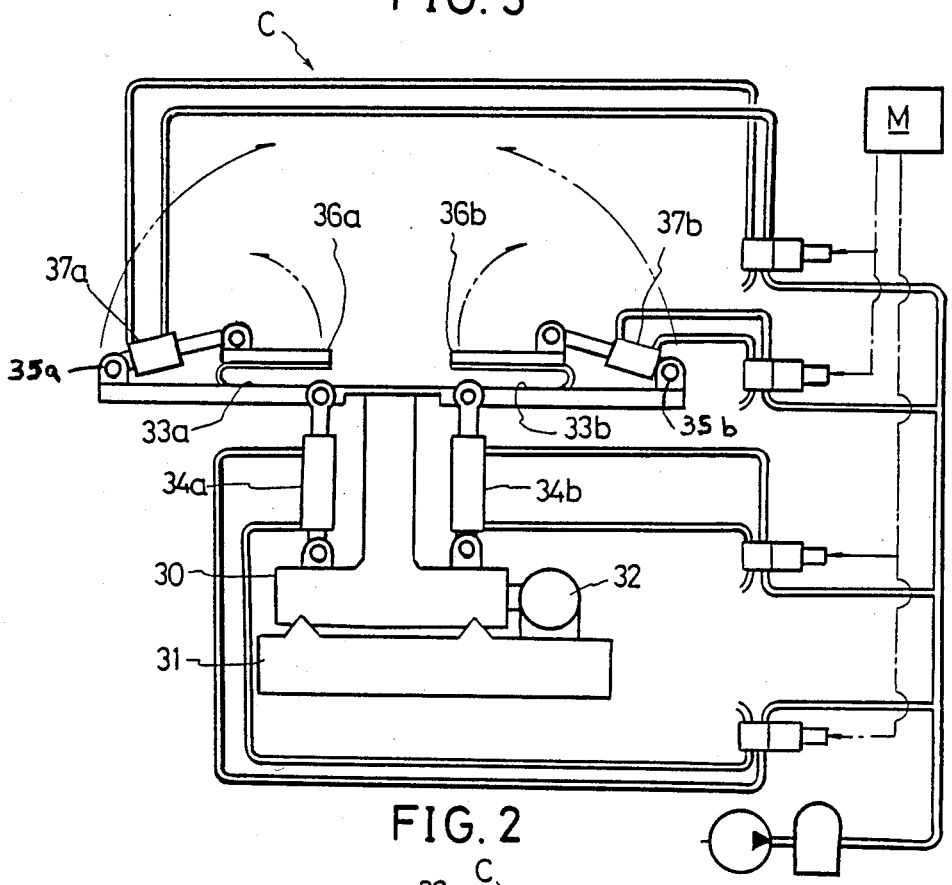
FIG. 3 is a front view representing a state wherein a sack group is held on the insertion means.
Figure 4:
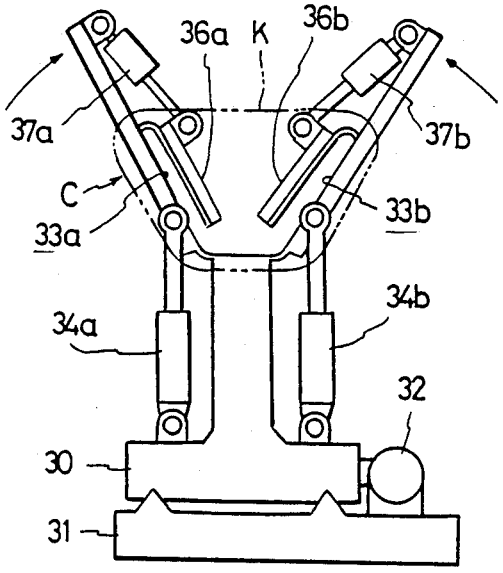
FIG. 4 is a front view representing a state wherein the sack group is bent by the insertion means of FIG. 3.

The moving pedestal 30 has a pair of left and right lower holding plates 33*a*, 33*b* hinged thereon so that the base ends will be inclined symmetrically from a horizontal state, and free ends of the lower holding plates 33*a*, 33*b* extend horizontally in a longitudinal direction of the mouth sealing means D. Pneumatic cylinder units 34*a*, 34*b* work as an inclination actuating means for the lower holding plates in pair. The lower holding plates 33*a*, 33*b* are provided with upper holding plates 36*a*, 36*b* hinged on outer edges 35*a*, 35*b* respectively, and small-type pneumatic cylinder units 37*a*, 37*b* also work for a closing operation of the upper holding plates 36*a*, 36*b* to the lower holding plates 33*a*, 33*b*. Outsides on free end sides of the upper and lower holding plates 33*a*, 33*b* and 36*a*, 36*b* have inclined edges 38*a*, 38*b* cut off slantwise, and other edges are kept in parallel with the guide rail 31 (FIG. 2 to FIG. 4).

Figure 2:
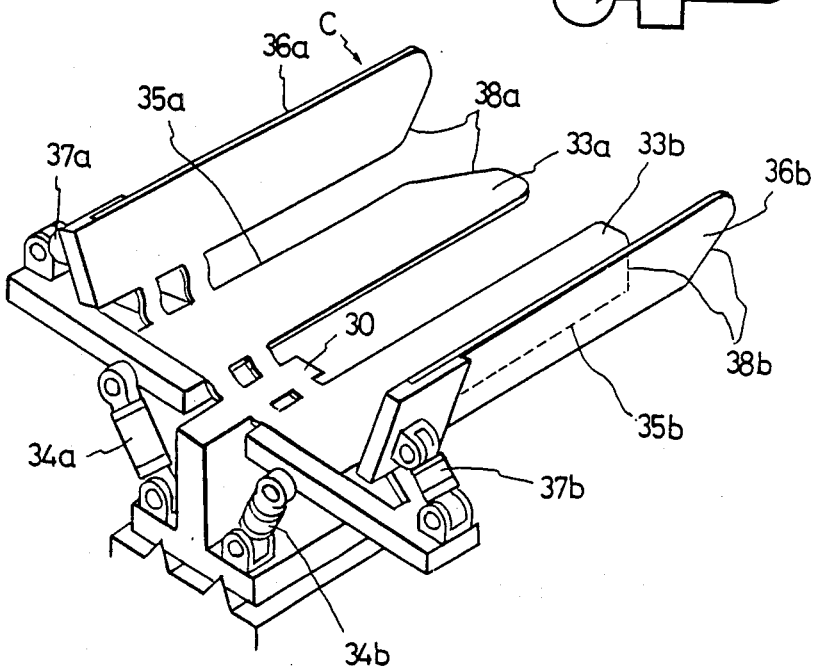
FIG. 2 is a perspective view of an insertion means.

A waiting position of the inserting means C comes near the sack manufacturing machine A, the lower holding plates 33*a*, 33*b* are both horizontal, the upper holding plates 36*a*, 36*b* are kept erect, and a height of the lower holding plates 33*a*, 33*b* is kept somewhat lower than the product receiver 20 (FIGS. 1 and 2).

Figure 7:
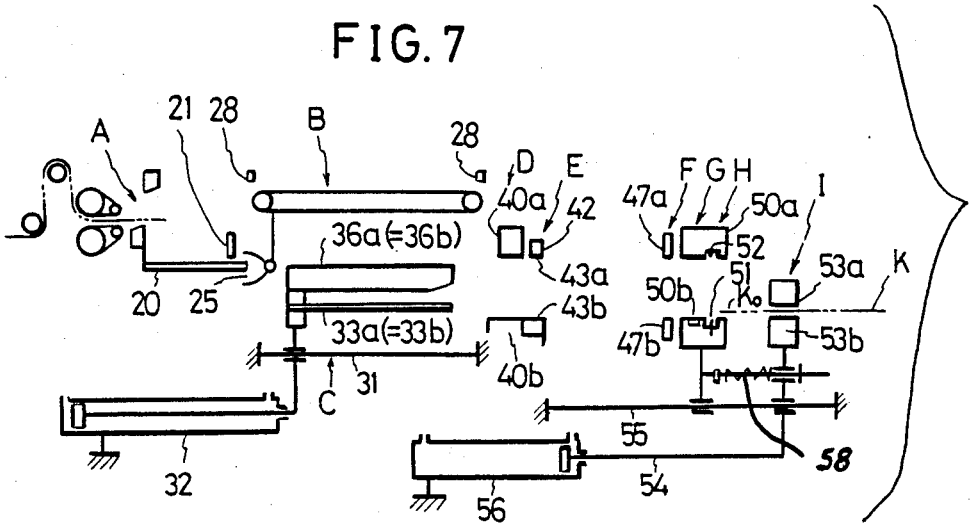
FIG. 7 to FIG. 11 are kinematic schemes showing operation of each means at the time of each process step of a method according to this invention.

The carrying means B is provided with a pair of holding claws 25 closable vertically for carrying the sack group Jo from the product receiver 20 onto the lower holding plates 33*a*, 33*b* of the inserting means C, the holding claws 25 wait at a delivery end position of the receiver 20 as opened and close to hold the sack group Jo on a signal indicating a completion of accumulation in a predetermined number of pieces, a support 26 of the holding claws 25 is led on the guide rail 27 to move onto the holding plates 33*a*, 33*b*, and then the holding claws 25 open and return to an original position. The carrying means B is given for example, and any means that is capable of carrying the sack group Jo straight will be acceptable other than that of the illustration. A closing position of the holding claws 25 and a stop position of the support 26 are determined by means of several position detecting sensors 28 (FIGS. 1 and 7).

The mouth sealing means D consists of a pair of holding jaws 40*a*, 40*b* for holding vertically a long flat tube band K normally used on a sack manufacturing machine, and at least one of the holding jaws 40*a*, 40*b* works at a heat sealer. No particular limitation is provided on the heating system, and hence a heat plate type with a heater embedded therein or held thereon or an impulse heating type can be used. A vertical move of the holding jaw 40*a* is given by a pneumatic cylinder unit 41.

Figure 5:
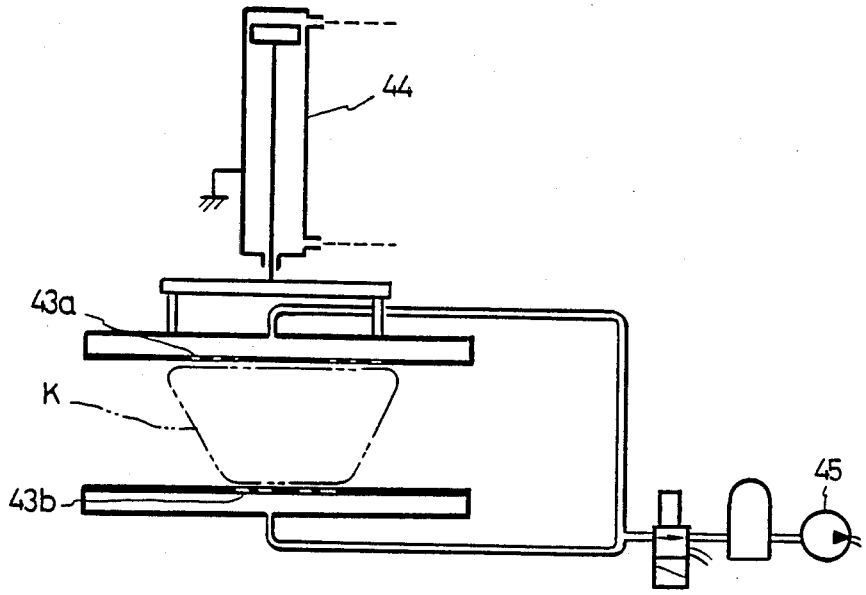
FIG. 5 is a front view in principle of a mouth opening means according to this invention.

The mouth opening means E is very close to the mouth sealing means D, the lower holding jaw is common to the lower jaw 40*b* of the mouth sealing means and provided with a sucking disk 43*b* ranging to a decompression air source 45 on the surface, a jaw 42 which is the upper moving member is also provided with a sucking disk 43*a* likewise on the lower surface, and a width of the sucking disks 43*a*, 43*b* is a little narrower than that of the flat tube K (FIG. 5). A vertical move of the jaw 42 which is the upper moving member of the mouth opening means E is also given by a pneumatic cylinder unit 44.

Figure 6:
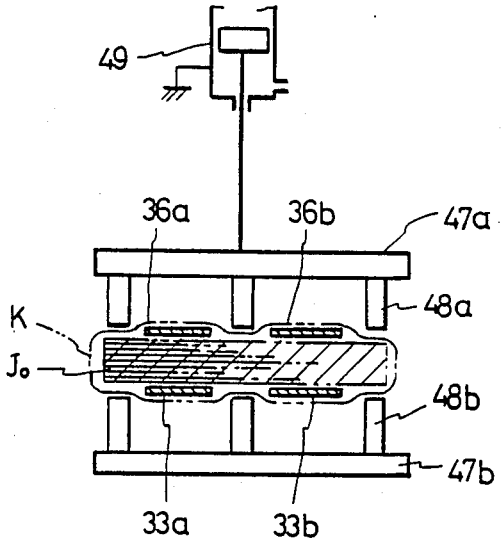
FIG. 6 is a front view representing a state wherein the sack group is held on a retaining means.

In the retaining means F, a pair of upper and lower holding members 47*a*, 47*b* for holding the flat tube vertically are provided with projections 48*a*, 48*b* respectively, and the projections 48*a*, 48*b* are positioned at a center and both side edges of the position not in contact with the holding plates 33*a*, 33*b*, 36*a*, 36*b* (FIG. 6).

A vertical move of the upper holding member 47*a* is also given by a pneumatic cylinder unit 49.

The bottom sealing means G has a structure similar to the mouth sealing means D, and in the illustrated mode a pair of holding jaws 50*a*, 50*b* are provided solidly with the cutting means H. Accordingly, one holding jaw 50*a* or 50*b* is provided with a sawtooth cutter 51, the other holding jaw is provided with a relief groove 52, and thus the flat tube band K can be cut right near the bottom seal, namely on the upstream side with reference to the direction in which the flat tube band K is carried. The upper holding jaw 50*a* is also moved vertically by a pneumatic cylinder unit 52.

In the illustrated mode, the carrying means I consists of a pair of upper and lower holding jaws 53*a*, 53*b*, which are ready for carrying the nose of the flat tube band K therein as far as a position of the mouth sealing means D and then resetting. Accordingly, a pedestal 54 of the lower holding jaw 53*b* is provided slidably on a guide rail 55 in the carrying direction and so arranged as to reciprocate on a horizontal pneumatic cylinder unit 56, the upper holding jaw 53*a* is capable of moving horizontally together with the lower holding jaw 53*b* and also moving vertically to the lower holding jaw 53*b* on a pneumatic cylinder unit 57 (FIG. 1, FIG. 7 to FIG. 10).

In the illustrated mode, an arrangement is such that the bottom sealing means G and the cutting means H are slidable both near the mouth sealing means D when the carrying means I moves, thereby exerting no prevention on operation of the carrying means I.

Figure 12:
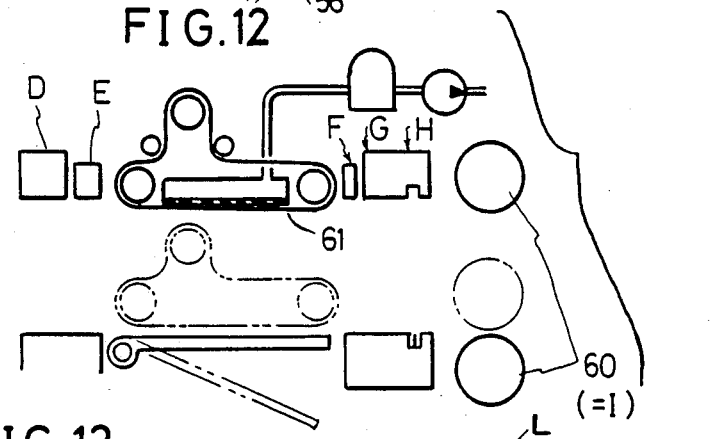
FIG. 12 is a kinematic scheme representing an embodiment of a carrying means according to this invention.

As for the illustrated carrying means I, no change will be brought essentially on the invention from using a transfer roller 60 in pair vertically for holding to come in contact with each other only at the time of carrying as shown in FIG. 12, and that with an adsorption belt conveyor 61 provided thereon which works between the mouth sealing means D and the retaining means F.

Next, an operation of the apparatus in the second invention which is constituted as mentioned above will be described with reference to FIG. 1, FIG. 7 to FIG. 11 along with the method in the first invention.

First, with the stopper 21 of the sack manufacturing machine A kept in contact with the product receiver 20, the holding claws 25 of the carrying means B are opened to wait ready for catching the sack group Jo on the product receiver 20. Then, the inserting means C is moved to the position coming nearest to the product receiver side by the pneumatic cylinder unit 32, the lower holding plates 33*a*, 33*b* are kept horizontal by pneumatic cylinder units 34*a*, 34*b*, and the upper holding plates 36*a*, 36*b* are kept vertical or somewhat expanded by pneumatic cylinder units 37*a*, 37*b* to waiting. Then, the holding claws 25 of the carrying means B are closed to catch the sack group Jo therein, the holding claws 25 are then moved to the inserting means C side, the sack group Jo is carried onto the lower holding plates 33*a*, 33*b*, the holding claws 25 are opened where nose of the sack group Jo almost coincides with the nose of the lower holding plates 33*a*, 33*b*, and the position of each position detecting sensor 28 is regulated for ready resetting.

Further, a stroke of the pneumatic cylinder unit 32 of the inserting means C is adjusted so that an end of the stroke for moving the inserting means C in the direction of the mouth sealing means D will come where a rear end of the sack group Jo on the inserting means C having passed the mouth sealing means D coincides with the position of the mouth opening means E.

Next, with each holding jaw, moving member and holding member from the mouth sealing means D to the carrying means I kept parting with each other vertically by the pneumatic cylinder units 41, 44, 49, 52 and 57 as shown in FIG. 1, a stroke of the pneumatic cylinder unit 56 is adjusted so as to have a maximum separation between the mouth sealing means D and the bottom sealing means G in dimension somewhat longer than the length of the sack J. The adjustment of strokes of the pneumatic cylinder unit 56 and the pneumatic cylinder unit 32 for the inserting means C can be effected by a known means of, for example, adjusting the position of a stroke limiting stopper or by a method wherein the position of a moving part is detected on a sensor and the air coming into the pneumatic cylinder units 32, 56 is controlled according to the operation of a control valve.

Then, a leading edge Ko of the flat tube band K is drawn out to the position of a cutter 51.

A synthetic resin flat tube molded according to inflation system is normally used for the flat tube band K, and the flat tube band K the width of which just comes in the sum of width and thickness of the sack group Jo or is somewhat greater than that is employed.

The means are then separated by a sequence control unit M in the following order:

First, the sack J is delivered successively onto the product receiver 20 of the sack manufacturing machine A and piled up in order after the stopper 21, and whenever it reaches a predetermined number of pieces, the stopper 21 ascends, the holding claws 25 close simultaneously to hold the sack group Jo therein and move in the direction of the inserting means C to put the sack group Jo onto the lower holding plates 33*a*, 33*b*. Meanwhile the stopper 21 descends to return to an original position, and the next sack J is delivered successively from the sack manufacturing machine A.

When the sack group Jo is placed on the lower holding plates 33*a*, 33*b*, the pneumatic cylinder units 37*a*, 37*b* are actuated, the upper holding plates 36*a*, 36*b* close inside, and the sack group Jo is held in the upper and lower holding plates 33*a*, 33*b*, 36*a*, 36*b* (FIG. 3).

Then the holding plates 33*a*, 33*b*, 36*a*, 36*b* are bent to a V-shape as holding the sack group Jo therein by the pneumatic cylinder units 34*a*, 34*b* (FIG. 4).

Figure 8:
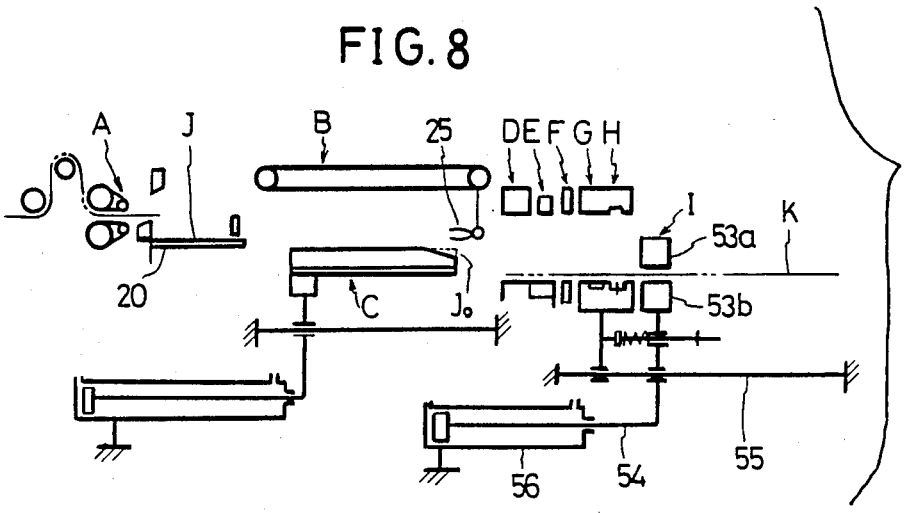

During the period in which the sack group Jo is supplied onto the inserting means C and bent, the holding jaws 53*a*, 53*b* of the carrying means I are brought in contact with each other by the pneumatic cylinder unit 57 to hold the flat tube band K therein (FIG. 7), moved in the direction of the mouth sealing means D by the pneumatic cylinder unit 56. The bottom sealing means G, the cutting means H and the retaining means F are also moved in the direction of the mouth sealing means D accordingly, and when these come in contact with the lower holding jaw 40*b* of the mouth sealing means D, the carrying means I compresses a spring 58 and further comes near to the mouth sealing means D to extrude the leading edge Ko of the flat tube band K to the position of the mouth sealing means D (FIG. 8).

Figure 9:
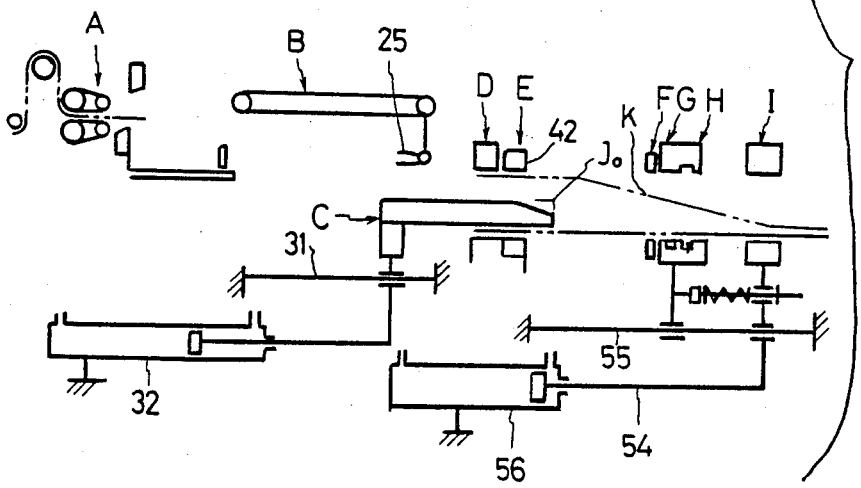
Figure 10:
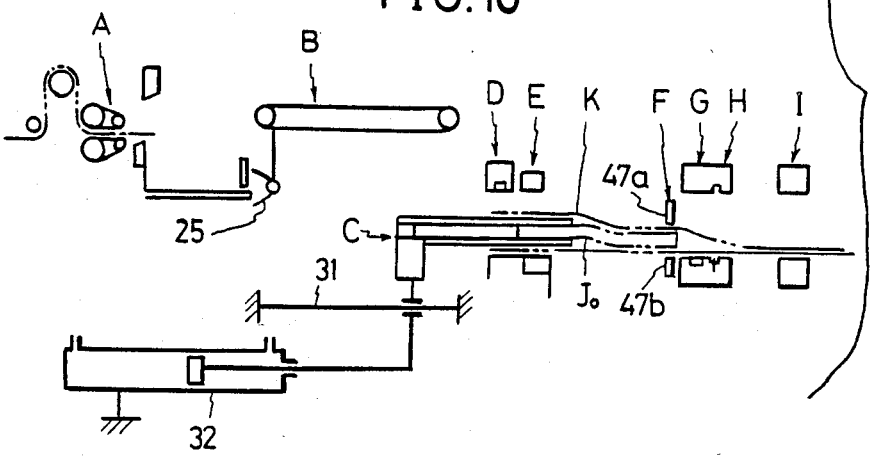
Figure 11:
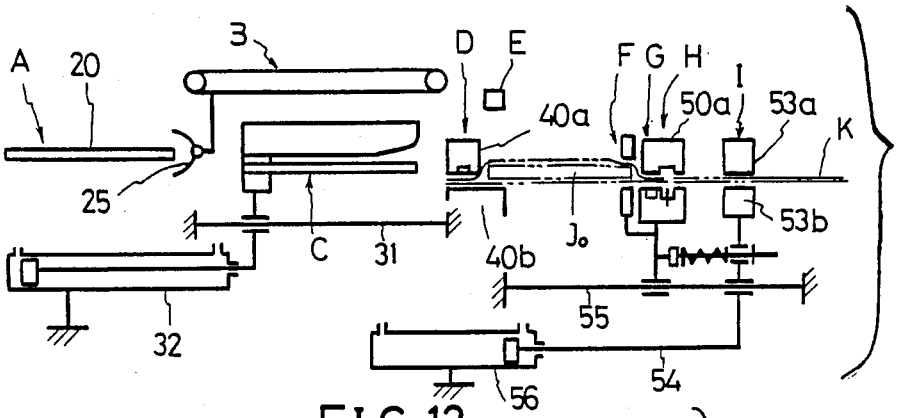

Next, the sucking disks 43*a*, 43*b* of the mouth opening means E come near each other to decompress and adsorb the nose of the flat tube band K vertically, the sucking disks 43*a*, 43*b* and the holding jaws 53*a*, 53*b* of the carrying means I are all parted each other vertically by the pneumatic cylinder units 44, 57 and thus the upper and lower films at the nose of the flat tube band K are parted, the nose of the flat tube band K is expanded vertically to a cylindrical form as shown in FIG. 4 and FIG. 9.

A form cylindrical in section of the flat tube band K is determined according to positions of the sucking disks 43*a*, 43*b* shown in FIG. 5. Therefore, when the sack group Jo is bent to V-shape by the inserting means C as described above, the upper sucking disk 43*a* is expanded horizontally, and a sectional form of the flat tube band K is adjusted to an inverted trapezoid or inverted triangle. Whenever the sack group Jo is bent to an inverted V-shape or angular shape (Λ), a disposition of the sucking disks 43*a*, 43*b* is reversed.

Then, the inserting means C is moved in the direction of the mouth sealing means D by the pneumatic cylinder unit 32, and the carrying means I and the retaining means F, the bottom sealing means G, the cutting means H are all reset.

The sack group Jo held and bent in the upper and lower holding plates 33*a*, 33*b* and 36*a*, 36*b* is inserted straight in the flat tube in accordance as the inserting means C moves, and where the rear end of the sack group Jo has just passed the mouth sealing means D, the inserting means C stops.

Next, the upper and lower holding plates 33*a*, 33*b* and 36*a*, 36*b* are reset again by the pneumatic cylinder units 34*a*, 34*b*, 37*a*, 37*b* as illustrated by a full line of FIG. 3.

The flat tube band K then parts from the upper sucking disk 43*a* to a flat state both. A decompressed state of the sucking disks 43*a*, 43*b* will have to be removed in this case.

Then, after being returned to the state shown in FIG. 3 by the full line, a pressure on the holding plates 33*a*, 33*b* and 36*a*, 36*b* is decreased somewhat as occasion demands.

During operation of the inserting means C in the flat tube band K, the carrying means B is reset to waiting.

Next, the retaining means F is made to come close, and thus the flat tube band K and the sack group Jo inserted therein are held vertically by the projections 48*a*, 48*b*.

The inserting means C is then returned to the original position to waiting again. A slow manner of motion will be preferable in this case.

The mouth sealing means D, the bottom sealing means G and the cutting means H are actuated simultaneously to weld and cut the flat tube band K longitudinally of the sack group Jo, these means are reset vertically and thus all the operating members make a round.

Figure 13:
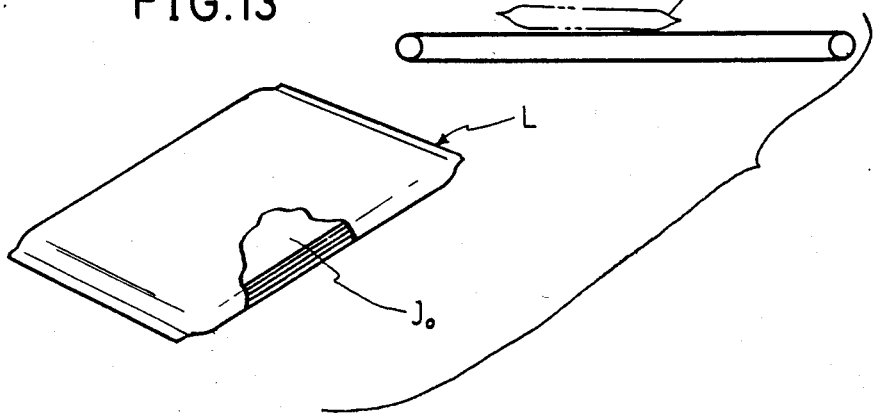
FIG. 13 is a perspective view of a package produced by the method and apparatus of this invention.

Further, a package L having packed the sack group Jo completely therein is obtained between the mouth sealing means D and the bottom sealing means G (FIG. 13).

The package L is carried downward or sideward.

This operation is repeated thereafter whenever a predetermined number of pieces of the sack J is piled up on the product receiver 20.

In the above-described embodiment, each solenoid control valve for each pneumatic cylinder unit and other power parts is operated by electromagnetic or electronic sequencers for the above-mentioned sequence control in a sequence control unit M. The invention can be practiced otherwise from employing a pneumatic control or that for which a totally mechanical sequencer or a computer is used.

The pneumatic cylinder units are employed as a power source for reciprocating motion of the carrying means B and the transfer means I, however, a known reversible motor can be employed otherwise for reciprocating motion in this invention.

In the method of the first invention which is constituted as mentioned above, the packaging flat tube band K does not look to be an outer sack in shape but is bottomless tubular, the upper and lower films at the nose of the flat tube band K are adsorbed separately to part vertically at the time of insertion of a matter to be packed, and thus the nose is open wide tubularly, therefore the matter to be packed does not get caught in the packaging tube band when inserted, the packaging tube band becomes tubular to allow the matter to come in as far as a bottom, the matter can be enclosed accurately in the packaging flat tube band K without fold or turnover and thus sealed completely.

In the apparatus of the second invention, the method of the first invention can be put into practice, an effect obtainable through the method is also ensured thereon, further the nose of the packaging flat tube band K can securely be transferred to the mouth opening means E by the transfer means I, the packaging flat tube band K is welded longitudinally of the matter inserted in the packaging flat tube band K by the mouth sealing means D and the bottom sealing means G, thus the matter can be sealed completely therein, and simultaneously with the welding the packaging tube band K is cut with the cutting means H near the bottom seal and upstream of the direction in which it is transferred, the package L is thus ready for carrying out between the mouth sealing means D in pair longitudinally and the bottom sealing means G, thereby obtaining the package L continuously.

In the method described above, the nose of the packaging flat tube band K which is subjected to decompression adsorption in the embodiment can be opened without staining the outside of the flat tube band K.

Then in the above-described apparatus, the matter to be packed is held vertically from outside the packaging flat tube band K by the retaining means F, which is so provided in the embodiment during welding and cutting operations on the mouth sealing means D, the bottom sealing means G and the cutting means H for the flat tube band K. Therefore the matter can be held compactly in the packaging flat tube band K during the operations, the weld is not capable of forming incompletely on a retaining strength of the packed matter, thus securing welding free from strain and satisfactory in strength.

What is claimed is:

1. A packaging method for soft build-up sheet-like matter, which method comprises:

(a) holding a piled-up sheet-like matter group to be packaged vertically in holding plates;

(b) bending the matter group as held therein by rotating arms of the holding plates towards each other to bend the matter group, said bending step forming a V-shape or an angular shape with the center portion working as an edge line and held in bent position;

(c) feeding the nose portion of a continuous thermowelding flat tube for packaging an outer sack near the bent sheet-like matter group in the direction of an edge line and expanded tubularly as far as said bent sheet-like matter group can be inserted;

(d) inserting said bent sheet-like matter group into said tube together with the holding plates, then rotating said arms to their initial position to unbend the piled-up sheet-like matter group to a horizontal state;

(e) next holding the sheet-like matter group vertically and fixed in place from outside the flat tube;

(f) then removing only the holding plates from inside the flat tube, then holding the flat tube only vertically;

(g) heating longitudinally the piled-up sheet-like matter group to weld only the upper and lower films; and then (h) cutting a portion of the flat tube ranging to an unaffected side of the flat tube to form packaged sheet-like matter.

2. A packaging method according to claim 1, wherein the matter being packaged are piles of flexible sacks made of synthetic resin thin film.

3. A packaging method for soft built-up sheet like matter said method comprising the steps:

(a) holding a pile of sheet-like articles, which are piled-up horizontally, on upper and lower surfaces thereof by a holding means;

(b) bending forceably the pile of sheet-like articles at its center line extending in a direction along which the pile will be inserted into a tube;

(c) inserting the bent pile together with said holding means into an expanded open end nose portion of said tube;

(d) unfolding the bent pile in the tube forceably by said holding means, so as to become parallel to upper and lower film portions of said tube;

(e) fixing the pile of sheet-like articles in place within the tube from outside of the tube;

(f) removing said holding means out of the tube;

(g) heat sealing a flat tube portion containing said pile at longitudinally upper ends thereof transversely; and (h) cutting off the tube portion from the flat tube so as to form an outer sack.

4. In a packaging apparatus for soft build-up sheet-like sacks, wherein piled-up sheets are held vertically, then bent and inserted into a portion of a flat tube band expanded tubularly, after which the bent sheet matter is straightened to a horizontal state in the flat tubes which is then welded and sealed longitudinally of the packaged sheet matter and cut from the flat tube, the improvement comprising:

(a) stacking means for the sheet like sacks;

(b) holding means having upper and lower arms for holding the stacked sheets;

(c) folding means for the stacked sheets;

(d) upper and lower suction means for opening the nose end portion of the flat tube;

(e) means for inserting the folded sacks into the nose portion of the opened tube;

(f) means for unfolding the folded sacks within the tube;

(g) means for heat sealing the tube portion adjacent the unfolded sacks, to provide a package; and (h) means for cutting the package off from the remaining flat tube.

* * * * *